US008418433B2

(12) United States Patent
Noguchi et al.

(10) Patent No.: US 8,418,433 B2
(45) Date of Patent: Apr. 16, 2013

(54) ELEVATOR WIRE ROPE

(75) Inventors: Naoaki Noguchi, Mito (JP); Tomio Hayano, Hitachi (JP); Taichi Maeda, Ushiku (JP); Takashi Teramoto, Tokyo (JP); Toshiyuki Moriya, Kasumigaura (JP); Ippei Furukawa, Kasumigaura (JP)

(73) Assignees: Hitachi, Ltd., Tokyo (JP); Tokyo Rope Mfg. Co., Ltd., Tokyo (JP)

( * ) Notice: Subject to any disclaimer, the term of this patent is extended or adjusted under 35 U.S.C. 154(b) by 0 days.

(21) Appl. No.: 13/180,244

(22) Filed: Jul. 11, 2011

(65) Prior Publication Data

US 2012/0005998 A1 Jan. 12, 2012

(30) Foreign Application Priority Data

Jul. 12, 2010 (JP) ..... 2010-157397

(51) Int. Cl.
*D07B 1/06* (2006.01)

(52) U.S. Cl.
USPC ..... 57/237; 57/241

(58) Field of Classification Search ..... 57/212, 57/222, 223, 232, 237, 241
See application file for complete search history.

(56) References Cited

U.S. PATENT DOCUMENTS

| | | | | | |
|---|---|---|---|---|---|
| 2,491,293 | A | * | 12/1949 | Zerr | 57/211 |
| 3,133,584 | A | * | 5/1964 | Lang | 152/556 |
| 3,374,619 | A | | 3/1968 | Adams et al. | |
| 3,600,884 | A | * | 8/1971 | Yazawa et al. | 57/213 |
| 3,686,855 | A | * | 8/1972 | Falcy et al. | 57/220 |
| 3,911,662 | A | * | 10/1975 | Fenner | 57/211 |
| 4,217,748 | A | * | 8/1980 | Fisher et al. | 57/212 |
| 4,422,286 | A | * | 12/1983 | Simpson et al. | 57/221 |
| 5,669,214 | A | * | 9/1997 | Kopanakis | 57/218 |
| 6,412,264 | B1 | * | 7/2002 | De Josez et al. | 57/217 |
| 7,137,483 | B2 | * | 11/2006 | Kato et al. | 187/251 |
| 7,272,921 | B2 | * | 9/2007 | Misrachi | 57/237 |
| 7,389,633 | B2 | * | 6/2008 | Misrachi | 57/223 |
| 7,650,742 | B2 | * | 1/2010 | Ushijima | 57/238 |
| 7,770,328 | B2 | * | 8/2010 | Vanderbeken et al. | 49/352 |
| 8,176,718 | B2 | * | 5/2012 | Ridge et al. | 57/212 |
| 2004/0231312 | A1 | * | 11/2004 | Honda | 57/241 |
| 2008/0236130 | A1 | * | 10/2008 | Furukawa et al. | 57/212 |

FOREIGN PATENT DOCUMENTS

| | | | |
|---|---|---|---|
| JP | 2003-268685 | A | 9/2003 |
| JP | 2006-9174 | A | 1/2006 |
| WO | WO 79/00182 | A1 | 4/1979 |

OTHER PUBLICATIONS

"Auf die Seele kommt es an", Feb. 1, 1993, pp. 8-10, No. 1, XP000345581.
European Search Report dated Jan. 17, 2012 (Eight (8) pages).

* cited by examiner

*Primary Examiner* — Shaun R Hurley
(74) *Attorney, Agent, or Firm* — Crowell & Moring LLP

(57) ABSTRACT

In an elevator wire rope 1 structured by twisting a plurality of schenkels 3, each schenkel 3 being formed by twisting a plurality of strands 2, each strand 2 being formed by twisting a plurality of fine steel wires 2*a* to 2*g*, the interior of the wire rope being filled with a resin 4, and the surface of the wire rope being covered with a resin 5, wherein the direction in which the fine steel wires 2*a* to 2*g* and the strands 2 are twisted and the direction in which the schenkels 3 are twisted are mutually opposite, and the diameter $d_4$ of the inscribed circle of the plurality of twisted schenkels 3 is smaller than the diameter $d_2$ of the schenkel 3.

12 Claims, 4 Drawing Sheets

| NUMBER OF SCHENKELS | TWISTING PITCH |
|---|---|
| PIECES | mm |
| 3 | 72 |
| 4 | 79 |
| 5 | 88 |
| 6 | 90 |
| 7 | 94 |
| 8 | 98 |
| 9 | 101 |

| NUMBER OF SCHENKELS | d1/d2 |
|---|---|
| PIECES | — |
| 3 | 2.2 |
| 4 | 2.5 |
| 5 | 2.9 |
| 6 | 3.2 |
| 7 | 3.6 |
| 8 | 4.0 |
| 9 | 4.4 |

ELEVATOR WIRE ROPE

CLAIM OF PRIORITY

The present application claims priority from Japanese Patent application serial no. 2010-157397, filed on Jul. 12, 2010, the content of which is hereby incorporated by reference into this application.

TECHNICAL FIELD

The present invention relates to a wire rope that suspends an elevator car of an elevator and, more particularly, to an elevator wire rope having an outer circumference covered with a resin.

BACKGROUND ART

An elevator car of an elevator is generally suspended by a wire rope. The wire rope is wound on the driving sheave of a winding machine. The elevator car is lifted and lowered by driving the winding machine and using friction between the rope groove on the sheave surface and the wire rope.

As for a machine room less elevator, the winding machine of which is disposed in the hoistway, the compactness of the winding machine is demanded to reduce the cross sectional area of the hoistway. A means for meeting this demand is to reduce the diameter of the driving sheave. When the diameter of the driving sheave is reduced, it becomes possible to use a low-torque motor in the winding machine to lift and lower the elevator car, enabling the motor to be compact. Accordingly, a highly flexible wire rope that can be easily bent along a driving sheave with a small diameter is demanded.

As a structure that increases the flexibility of a wire rope, a wire rope as disclosed in, for example, Patent Literature 1 is already proposed. That is, the wire rope disclosed in Patent Literature 1 uses fine steel wires, each of which is obtained by wiredrawing an elemental wire of the wire rope to make it fine, the fine steel wire having a breaking force increased to 2600 MPa or more (the breaking force of an elemental wire of a normal A-type elevator wire rope is about 1600 MPa). If a steel wire is made fine, it can be easily bent even when it wound on a driving sheave with a small diameter, so a contact length between the rope groove and the wire rope can be ensured.

However, the steel wire that is made fine in this way is likely to cause a fatigue failure due to fretting wear attributable to the reduction of the cross sectional area of the steel wire. Accordingly, the wire rope disclosed in Patent Literature 1 has a structure in which the circumferences of schenkels formed from fine steel wires and strands are filled with a resin and the entire wire rope is covered with a resin. The resin covering layer has spacer parts that prevent contacts between adjacent schenkels and leaves substantially equal spacings between the schenkels placed along a circumference so that the schenkels are not easily brought into metal contact with one another.

CITATION LIST

Patent Literature

[Patent Literature 1] Japanese Patent Laid-open No. 2006-9174

SUMMARY OF INVENTION

Technical Problem

In general, a wire rope has a property (rotating property) in which when a tensile force or bending force is exerted thereon, the entire wire rope rotates around the central axis of the wire rope. With an elevator, when the wire rope passes over the rope groove in the driving sheave, the wire rope very slightly slides on the rope groove due to the rotating property. By contrast, with the wire rope disclosed in Patent Literature 1, the outer circumference of which is covered with a resin, since the frictional coefficient between the rope groove and an outer layer resin is high, the outer circumferential surface of the wire rope is constrained within in the rope groove. Accordingly, torque generated in the wire rope acts as a force with which the covering resin is twisted, so if the wire rope is used for a long period of time, the covering resin may be damaged and the wire rope may be exposed, which may lower the friction force between the wire rope and the driving sheave.

To prevent this problem, a wire rope having a surface covered with a resin is demanded to have a property in which even if a tensile force is applied, rotation is not easily caused. With the wire rope disclosed in Patent Literature 1, however, attention is mainly paid to the improvement in resistance to bending fatigue and the rotational property is not considered at all.

An object of the present invention is to provide an elevator wire rope that reduces a twisting force, which is exerted on a covering resin due to the rotation of the wire rope when the wire rope passes on a driving sheave.

Solution to Problem

To achieve the above object, in an elevator wire rope structured by twisting a plurality of schenkels, each schenkel being formed by twisting a plurality of strands, each strand being formed by twisting a plurality of fine steel wires, the interior of the wire rope being filled with a resin, and the surface of the wire rope being covered with a resin, in the present invention, the direction in which the fine steel wires and the strands are twisted and the direction in which the schenkels are twisted are mutually opposite, and the diameter of the inscribed circle of the plurality of twisted schenkels is smaller than the diameter of the schenkel.

That is, when the diameter of the inscribed circle of a plurality of twisted schenkels is smaller than the diameter of the schenkel, the schenkels can be brought close to the center of the wire rope; as a result, torque represented by the product of a force with which each schenkel serves in the circumferential direction when a tensile force is exerted on the wire rope and the distance from the center of the wire rope to the center of the schenkel (the torque will be referred to as the entire rope torque below) can be reduced. If the lay direction of the schenkels is right (Z twisting), for example, when the lay direction of the fine steel wires and the strands is left (S twisting), the torque generated in the fine steel wire and the strand and the torque generated in the schenkel are generated in directions in which these torques are mutually cancelled.

Since, as described above, the entire rope torque is reduced and the lay directions are set to directions in which the torque generated in the schenkels is reduced, the torque generated in the wire rope can be reduced, by which the rotating property in which the entire wire rope rotates around the central axis of the wire rope is reduced and the force with which the covering resin is twisted is thereby reduced; as a result, damage of the covering resin, which would be otherwise caused by the rotating property, can be suppressed.

Advantageous Effects of Invention

As described above, according to the present invention, an elevator wire rope can be obtained that reduces a twisting force exerted on a covering resin due to the rotating property of the wire rope when the wire rope passes on a driving sheave.

DESCRIPTION OF EMBODIMENTS

Figure 1:
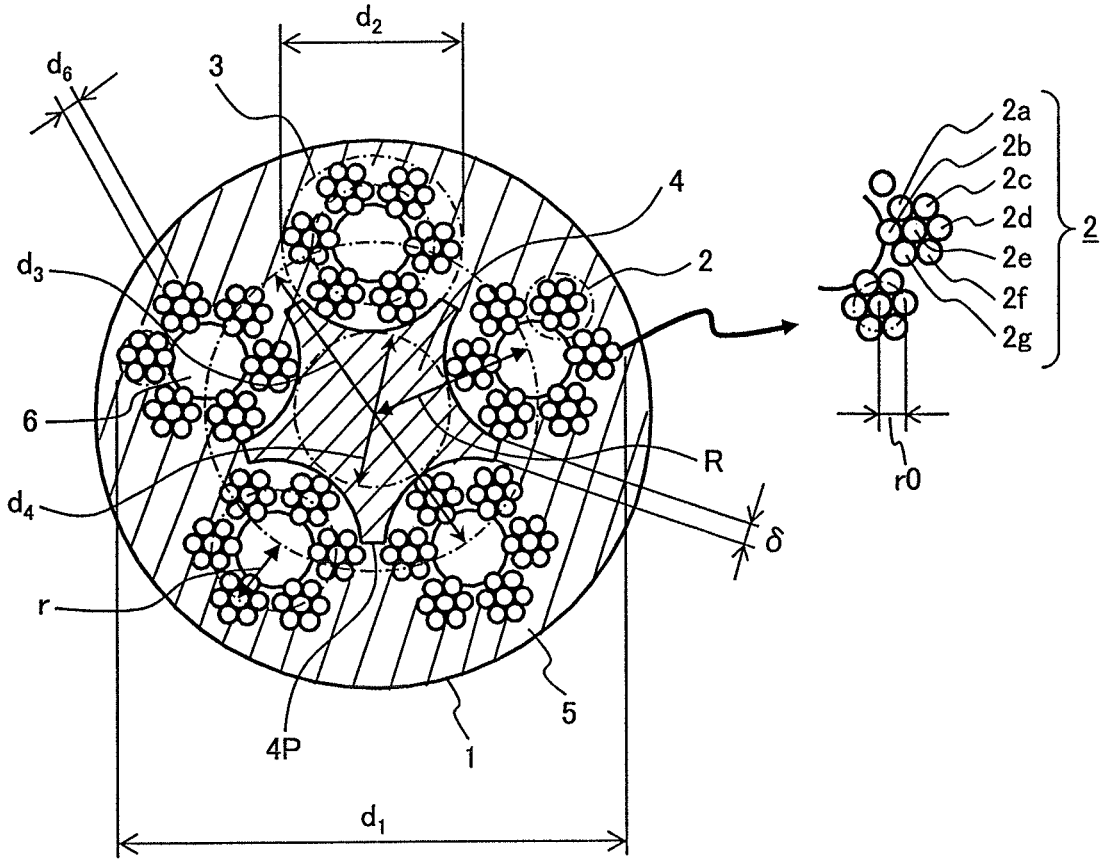
FIG. 1 is a cross sectional view of a first embodiment of an elevator wire rope according to the present invention.

An embodiment of an elevator wire rope according to the present invention will be described with reference to FIG. 1.

The elevator wire rope 1 is formed by twisting a plurality of schenkels 3, each of which is formed by twisting a plurality of strands 2, and each of which is formed by twisting a plurality of fine steel sires 2*a* to 2*g*. An inner layer resin 4 is provided at the center of the elevator wire rope 1, the schenkels 3 being twisted on the inner layer resin 4. The plurality of schenkels 3 are disposed around a circumference with almost equal spacings 8 being left among them, and the inner layer resin 4 has projections 4P to ensure the spacings 8 so that adjacent schenkels 3 are not brought into direct contact with each other.

An outer layer resin 5 covers the entire outer circumferences of a plurality of schenkels 3 to prevent a metal contact with a driving sheave. For the inner layer resin 4 and outer layer resin 5, a material superior in abrasion resistance and oil resistance, such as, for example, urethane resin is preferably used. If these layers are formed with the same material, the adhesiveness between the resin of the internal layer and the resin of the outer layer can be increased. The inner layer resin 4 may be formed with a resin material superior in abrasion resistance and ease of sliding, and the outer layer resin 5 may be formed with a resin material in which an additive, such as, for example, aluminum powder is mixed to ensure traction with the sheave.

The schenkels 3, the strands 2, and the fine steel wires 2*a* to 2*g* may be each placed in a single layer in radial directions around a circumference; besides this placement, they may be placed as two layers, many schenkels 3, many strands 2, and many fine steel wires 2*a* to 2*g* may be each bound without forming a layer, and some other structures may be considered. In this embodiment, to reduce the number of manufacturing person hours and the frictional coefficient due to strand contact, the schenkels 3, the strands 2, and the fine steel wires 2*a* to 2*g* are each placed in a single layer in radial directions around a circumference. A resin core 6 is placed inside each schenkel 3 formed by twisting the plurality of strands 2.

In this embodiment, no schenkel is placed at the center at which the inner layer resin 4 is located, but five schenkels 3 are placed around the outer circumference of the inner layer resin 4. Although the number of schenkels 3 is five in FIG. 1, the number is not limited to five if a relational expression described later is satisfied and a result of calculation explained later is within an area in a limit diagram defined by the stress and cross sectional area. The diameter $d_4$ of the inscribed circle of the inner layer resin 4, which has the projections 4P so as to form a star shape, is smaller than the diameter $d_2$ of the schenkel 3.

Next, the method of reducing torque coefficient K, which is an index of the rotating property of the wire rope will be described below in detail.

The elevator wire rope 1 has a property (rotating property) in which when a tensile force or bending force is exerted thereon, the entire rope rotates around the central axis of the rope. With an elevator, in case of a normal wire rope, when the wire rope passes on the driving sheave, the wire rope very slightly slides on the rope groove in the driving sheave due to the rotating property. In a case of a wire rope covered with a resin, however, since the frictional coefficient between the outer layer resin and the driving sheave is higher than the frictional coefficient between wires, the outer layer resin is constrained in the rope groove. Accordingly, the outer layer resin receives a force in a lay direction, so the resin may be damaged during a long period of usage.

In this embodiment, in case of a so-called secondary twisted wire, which is formed by twisting the fine steel wires 2*a* to 2*g* and strands 2, the torque coefficient K is given by a dimensionless quantity $K=T/(W\times D)\times 10^{-3}$, where W is a tensile force (N), T is torque (N·m) due to the tensile force W, and D is the rope diameter (mm). That is, the closer to 0 the index is, the smaller the rotating property is. Furthermore, if the diameters of the schenkels and strands constituting the wire rope, the layer core diameter, and other variables are used for the torque, the torque coefficient in the secondary twisting configuration can be expressed in expression (1). If this expression is applied to a so-called three-layer wire rope, which is formed by twisting the fine steel wires 2*a* to 2*g*, strands 2, and schenkels 3 to form the wire rope shown in FIGS. 1 and 2, expression (2) is obtained.

$$K=T/(W\times D)\times 10^{-3}=(N1\cdot F1\cdot R\cdot \sin\alpha+N2\cdot F2\cdot r\cdot \sin\beta)/(W\times D)\times 10^{-3} \quad \text{expression (1)}$$

where N1 is the number of strands within the cross section of the rope, F1 is a tensile force (N) exerted on one strand, R is a rope layer core radius (m), α is the strand twisting angle (°), N2 is the number of fine steel wires within the cross section of the rope, F2 is a tensile force (N) exerted on one fine steel wire, r is a strand layer core radius (m), and β is a fine steel wire twisting angle (°).

$$K=T/(W\times D)\times 10^{-3}=(N1\cdot F1\cdot R\cdot \sin \alpha+N2\cdot F2\cdot r\cdot \sin \beta+N3\cdot F3\cdot r0\cdot \sin \gamma)/(W\times D)\times 10^{-3} \quad \text{expression (2)}$$

where N1 is the number of schenkels within the cross section of the rope, F1 is a tensile force (N) exerted on one schenkel, R is a schenkel layer core radius (m), α is a schenkel twisting angle (°), N2 is the number of strands within the cross section of the rope, F2 is a tensile force (N) exerted on one strand, r is a strand layer core radius (m), β is the strand twisting angle (°), N3 is the number of fine steel wires within the cross section of the rope, F3 is a tensile force (N) exerted on one fine steel wire, r0 is a fine steel wire layer core radius (m), and γ is the fine steel wire twisting angle (°).

Figure 2:
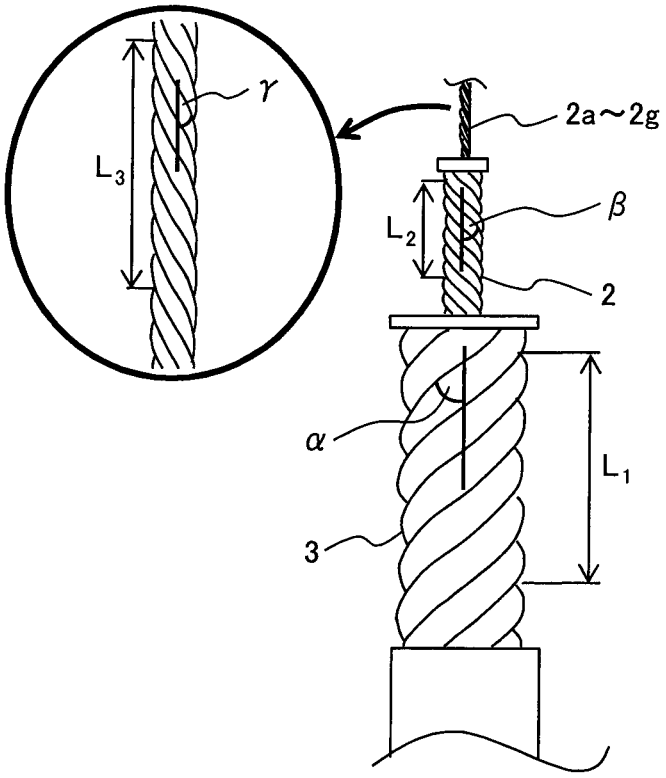
FIG. 2 illustrates a direction in which the elevator wire rope shown in FIG. 1 is twisted.

For the embodiment of the present invention, the lay direction of the wire rope will be described next with reference to FIG. 2.

In this embodiment, the lay direction of the schenkel 3 is right (z twisting), the lay direction of the strand 2 is left (s twisting), and the lay direction of the fine steel wire is left (s twisting). Even when a schenkel layer core diameter $d_3$ is small, the torque generated by the entire rope is not reduced to 0, so the lay direction of the schenkel 3 and the lay directions of the strand 2 and fine steel wires 2*a* to 2*g* are made opposite to each other so that the torque represented by the first term in equation (2) (the torque will be referred to as the entire rope toque below) is canceled by the torques generated by the strand 2 and fine steel wire, which are represented by the second term and third term in equation (2). The second term in equation (2) will be referred to as the schenkel torque below, and the third term in equation (2) will be referred to as the strand torque below.

The strand torque is only 10% or less of the entire rope torque and schenkel torque because the fine steel wire layer core radius r0 is sufficiently smaller than the strand layer core radius r. Accordingly, if the entire structure is determined by mainly considering the entire rope torque and schenkel torque and fine adjustment of the entire twisting pitch of the rope is finally performed, the torque coefficient can be completely reduced to 0 with ease.

The relation between the twisting angle and the torque coefficient will be described. Since the total tensile force exerted on the rope is substantially equal to the total tensile force exerted on the schenkel, N1·F1=N2·F2 holds in equations (1) and (2). In the geometrical relation of the rope, since the schenkel layer core radius R is greater than the strand layer core radius r, if the rope twisting angle α in the first term is reduced (the twisting pitch $L_1$ is prolonged), and the strand twisting angle β in the second term is increased (the twisting pitch $L_2$ is shortened), the torque coefficient can be adjusted to reduce its value.

To improve the ease of bending and resistance to bending fatigue for the elevator wire rope 1 while the design guideline described above is followed, a necessary breaking force must be assured, the outer diameter of the elevator wire rope 1 must be reduced, and the diameter of the fine steel wire must be reduced. That is, to cancel the entire rope torque with the schenkel torque, it is desirable that the schenkel torque is increased with as small a rope diameter as possible. To do this, the number of schenkels 3 must be increased, the strand layer core radius r must be enlarged, or both must be carried out. However, these countermeasures increase the diameter of the elevator wire rope 1, so the schenkel layer core radius R of the elevator wire rope 1 is increased accordingly. That is, if the number of schenkels 3 is set as described above and the inner layer resin 4 is structured as described above, the placement of the schenkels 3 in radial directions and the number of schenkels can be optimally set with ease, and a rope with a superior torque balance can be structured while resistance to bending fatigue and other properties are satisfied.

Next, ranges in which the values of the design variables in equation (2) can be taken will be described in detail with reference to FIGS. 3A to 3D and 4. In addition to the torque coefficient, the breaking force and bending resistance life are other performance indexes needed for the elevator wire rope 1. FIGS. 3A to 3D show the torque coefficient and breaking force, and FIG. 4 shows bending stress during bending.

Figure 3A:
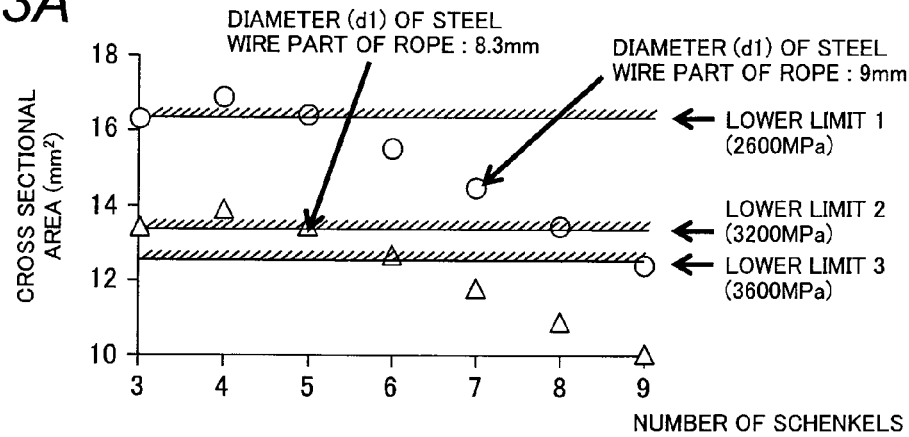
FIG. 3A illustrates the relations between the number of schenkels in the elevator wire rope shown in FIG. 1 and the cross sectional area.
Figure 3B:
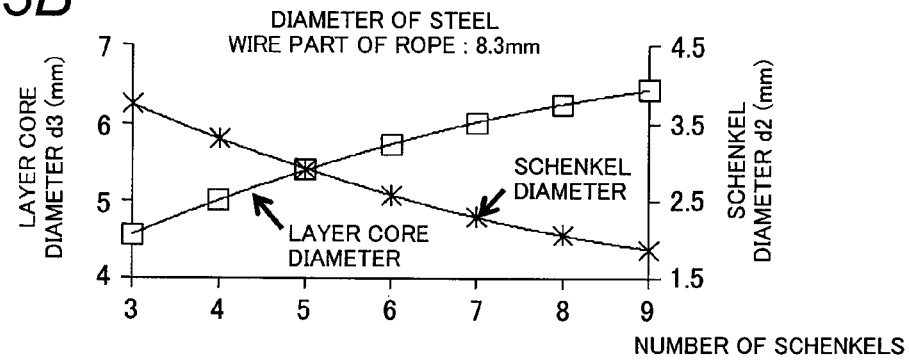
FIG. 3B illustrates the relations between the number of schenkels in the elevator wire rope shown in FIG. 1 and the layer core diameter.
Figure 3C:
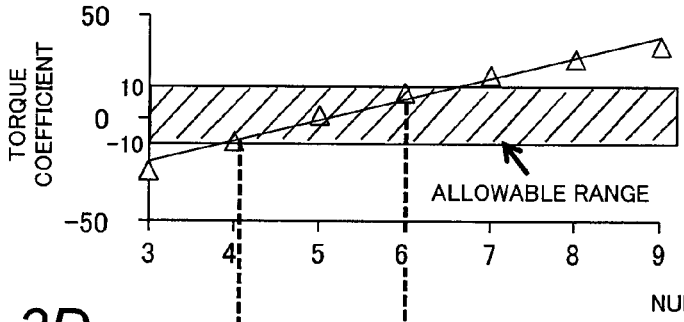
FIG. 3C illustrates the relations between the number of schenkels in the elevator wire rope shown in FIG. 1 and the torque coefficient.

In FIGS. 3A to 3D, the number of schenkels is shown on the horizontal axis. FIG. 3A shows the relations between the number of schenkels and the cross sectional area ($mm^2$). FIG. 3B shows the relations between the number of schenkels and the schenkel layer core diameter ($d_3$). FIG. 3C shows the relations between the number of schenkels and the torque coefficient. The schenkels 3 were placed along a circumference in a single layer in radial directions with the schenkel layer core diameter being $d_3$, as a structure that can reduce the number of manufacturing person hours and a loss due to friction generated among the adjacent schenkels 3 during bending. In general, as the number of elevator ropes is smaller, the driving sheave can be made thinner and the winding machine can be thereby made thinner. In addition, if the number of ropes is small, work involved in the tensile force adjustment for the rope and its replacement can also be reduced.

For the number of wire ropes 1, FIG. 3A shows the lower limit of the breaking force that satisfies a rope safety ratio of 10 stipulated in the Building Standard Law in Japan and achieves the number of wire ropes equal to or smaller than the number of steel wires with a diameter of 10 mm. In FIG. 3A, each circle (○) indicates a calculation example taken when the outer diameter $d_1$ of the steel wire part of the wire rope 1 is 9 mm, and each triangle (Δ) indicates a calculation example taken when the outer diameter is 8.3 mm. As is clear from this drawing, as the number of schenkels 3 is increased, the area of the inner layer resin 4 at the center is enlarged and the diameter of the schenkel 3 is reduced. Accordingly, the cross sectional area of the steel wire part tends to reduce as the value on the horizontal axis is increased. When the number of schenkels is six or more, the occupation ratio of the steel wires is lowered and the occupation ratio of the reins layer is increased. In this case, the resin material, which is more expensive than the steel material, must be much used, and the manufacturing cost of the wire rope 1 is likely to increase. From the viewpoint of the cross sectional area, therefore, it is found that the outer diameter of the wire rope should be small and the number of schenkels should be small.

The drawing also shows that when the strength of the fine steel wire is 3600 MPa and the outer diameter $d_1$ of the steel wire part of the wire rope 1 is 9 mm, the number of schenkels can be ranged from three to eight. When the outer diameter $d_1$ of the steel wire part of the wire rope 1 is reduced to 8.3 mm, however, the range of the number of schenkels is three to six, lowering the design freedom. In the case of a fine steel wire strength of 2600 MPa, when the outer diameter $d_1$ of the steel wire part of the wire rope 1 is 8.3 mm, there is no applicable schenkel; when the outer diameter $d_1$ of the steel wire part of the wire rope 1 is 9 mm, the range of the number of schenkels is three to five. When the fine steel wire part of the wire rope 1 is structured with the outer diameter $d_1$ being set to, for example, 8.8 mm rather than reducing to 8.3 mm, the distance between the schenkels 3 (8 in FIG. 1) is elongated, so there are merits in that the likelihood for the friction of the inner layer resin 4 and that manufacturing variations can be alleviated. As described above, the outer diameter $d_1$ of the steel wire part of the wire rope 1 and the number of schenkels can be determined in consideration of the strength of the fine steel wire to be used and the amount of usage of the resin.

Under the condition that the outer diameter $d_1$ of the steel wire part of the wire rope 1 is 8.3 mm, FIG. 3B shows the schenkel layer core diameter ($d_3$ in FIG. 1) on a first axis at left, and also shows the schenkel diameter ($d_2$ in FIG. 1) on a second axis at right. The figure indicates that as the number of schenkels 3 is increased, the schenkel diameter $d_2$ reduced and, conversely, the schenkel layer core diameter $d_3$ is increased because the schenkels move toward the outer circumference of the rope.

FIG. 3C shows the calculation results of the torque coefficient that were carried out by using values obtained in FIG. 3B. When the schenkel twisting pitch $L_1$ described above is 88 mm (the outer diameter $d_1$ of the steel wire part of the wire rope 1 is 8.3 mm), the twisting angle of the schenkel 3 is sin $\alpha$=0.189. As the schenkel twisting pitch $L_1$ in each number of schenkels, the twisting pitch values in the table at right were used with the twisting angle left unchanged. If urethane resin used as the resin and allowable torque coefficient values are defined to be in the range of the shaded area according to the fatigue strength of this material, it is found that the values taken when the number of schenkels 3 is from four to six are allowable values. The torque coefficient is increased outside the range.

Figure 3D:
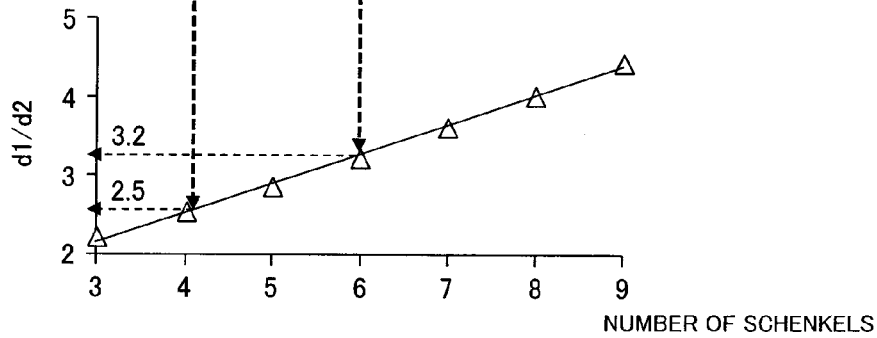
FIG. 3D illustrates the relation between the outer diameter $d_1$ of the steel wire part of the wire rope and the schenkel diameter $d_2$, that satisfies the allowable values obtained from FIG. 3C.
Figure 4:
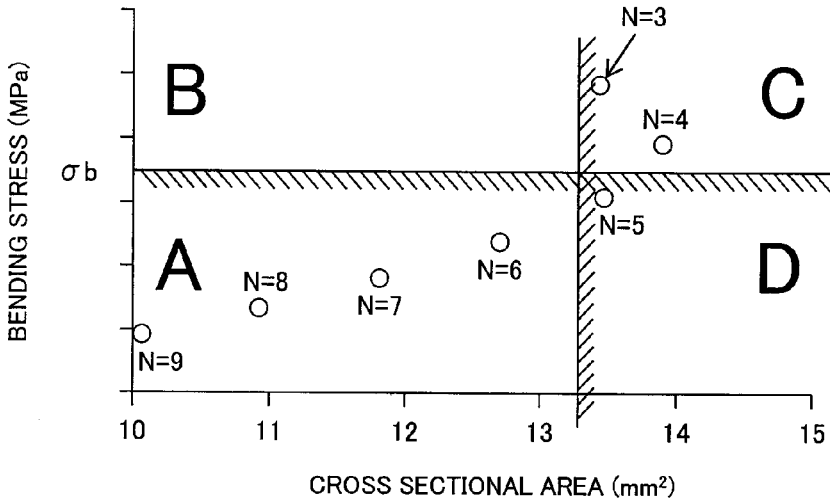
FIG. 4 illustrates the relation between the cross sectional area of the elevator wire rope shown in FIG. 1 and the bending stress of the elementary wire.

FIG. 3D shows the relation between the outer diameter $d_1$ of the steel wire part of the wire rope 1 and the schenkel diameter $d_2$, that satisfies the allowable values obtained from FIG. 3C. This drawing shows that $d_1/d_2$ only needs to be within the range of 2.5 to 3.2.

Next, the relation between the bending stress and the cross sectional area at a portion of the driving sheave on which the wire rope is wound will be described, with reference to FIG. 4. As for the elevator wire rope 1, as the bending stress at the bent portion of the driving sheave is smaller, the stress amplitude becomes smaller, and the life can be thereby likely to be prolonged. An exemplary method of calculating the bending stress is the Chitaly's equation indicated as equation (3) (reference: "Wire Rope Handbook", Nikkan Kogyo Shimbun Ltd., 1995.03).

$$\sigma = E \cdot \cos \Phi \cdot \delta / Ds \qquad \text{equation (3)}$$

where $\sigma$ is bending stress (Pa), E is the vertical elastic coefficient (Pa) of the elementary wire of the rope, $\Phi$ is the twisting angle (°), $\delta$ is the fine steel wire diameter (m), and Ds is the diameter (m) of the portion of the driving sheave on which the wire rope is wound.

The vertical axis in FIG. 4 shows the bending stress of the fine steel wire that was calculated from equation (3). The horizontal axis in the drawing shows the cross sectional area calculated in FIG. 3A; values of the cross sectional area are plotted on the horizontal axis and values of the bending stress of the fine steel wire are plotted on the vertical axis. For reference purposes, the ratio $d_1/d_2$ of the outer diameter $d_1$ of the steel wire part of the wire rope 1 to the schenkel diameter $d_2$ is indicated in correspondence to the number of schenkels 3. As the number N of schenkels 3 is reduced, the cross sectional area is increased; when the number is four, the cross sectional area is maximized. It is found that the bending stress generated when the number of schenkels is four is greater than the bending stress generated when the number of schenkel is five. To assure a breaking force sufficient for the elevator wire rope, there is a lower limit for the cross sectional area. To achieve a prolonged life against bending, there is an upper limit $\sigma b$ for bending stress. This upper limit is determined according to the fatigue strength of the steel material used and is affected by the state of fretting wear of the fine steel wire and by variations in fine steel wire strength. When a material having a fine steel wire strength of 2600 MPa and fretting wear is taken into consideration, $\sigma b$ only needs to be set to, for example, 250 MPa or less. The graph in the drawing is divided into four areas, area A to area D, according to the upper limit and lower limit. It is found that the area A is an area in which the bending stress is small but the cross sectional area is insufficient, the area B is an area in which the bending stress is high and the cross sectional area is insufficient, and the area C is an area in which although the cross sectional area is sufficient, the bending stress is high. Thus, it is found that an area in which the cross sectional area is sufficient and the bending stress can be reduced is the area D and that when the number of schenkels is the number of schenkels in this areas, that is, five in this calculation example, various performance requirements for the wire rope 1 are satisfied.

Under the restriction conditions described above, in this embodiment, when the number of schenkels 3 was five and the diameter of the fine steel wire was 0.29 mm, the schenkel diameter was 2.9 mm, the outer diameter $d_1$ of the steel wire part of the wire rope 1 was 8.3 mm, and the schenkel twisting pitch $L_1$ was 88 mm, which is the lower limit used to reduce the torque coefficient to zero.

Figure 5:
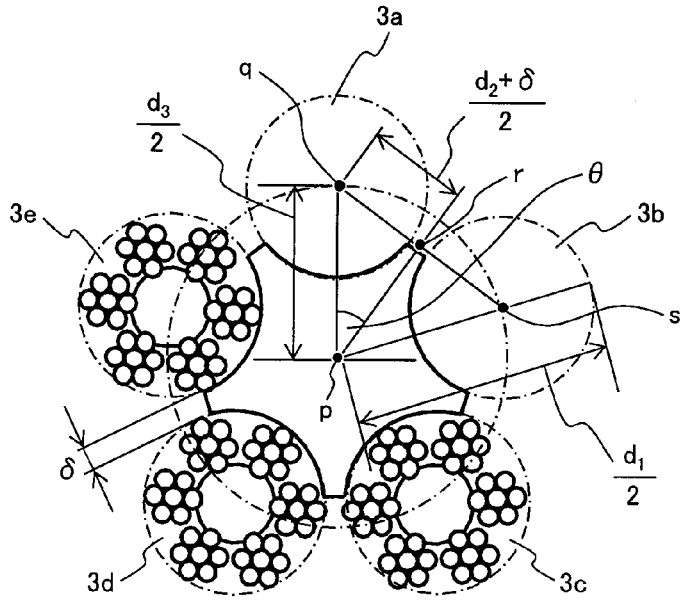
FIG. 5 is an enlarged cross sectional view showing the vicinity of the center of the elevator wire rope in FIG. 1.

FIG. 5 shows the geometrical relation between the schenkel layer core diameter $d_3$ and the number of schenkels 3. For the schenkels 3*a* and 3*b*, the strand 2 is omitted so that the geometrical relation can be easily seen. Equation (4) holds for the schenkel layer core diameter $d_3$ and schenkel diameter $d_2$ from the right triangle formed with the center p of the wire rope, the center q of the schenkel 3*a*, and the midpoint r of the straight line connecting the centers q and s of the schenkels 3*a* and 3*b*, which are adjacent to each other.

$$(d_2+\delta)/d_3 = \sin\theta \qquad \text{equation (4)}$$

If $\eta$ is $\delta$ (thickness of the projection 4P of the inner layer resin 4)/$d_2$ (schenkel diameter), equation (5) holds $$d_2/d_3 = \sin\theta/(1+\eta) \qquad \text{equation (5)}$$

The following relation holds for the schenkel layer core diameter $d_3$, the schenkel diameter $d_2$, and the diameter $d_4$ of the inscribed circle of the inner layer resin 4 in a star shape in FIG. 1.

$$d_3 = d_2 + d_4 \qquad \text{equation (6)}$$

If $d_3$ is deleted by using equation (5) and equation (6) and these equations are solved for 0, equation (7) holds.

$$\theta = \sin^{-1}\{(1+\eta)/(1+\epsilon)\}(°) \qquad \text{equation (7)}$$

where $\eta$ is $\delta/d_2$ and $\epsilon$ is $d_4/d_2$.

Thus, the number N of schenkels 3 that satisfies various properties of the wire rope 1 covered with a resin, which are the torque coefficient, cross sectional area, and bending stress, can be obtained by using $\theta$ (degrees) and rounding up the value of $N=180/\theta$ to an integer.

As described above, when the value of the ratio of the outer diameter $d_1$ of the steel wire part of the wire rope to the schenkel diameter $d_2$ is from 2.5 to 3.2, the ratio is sufficient for the elevator wire rope. Therefore, when the relational expression $d_1=2\times d_2+d_4$ is used, $\epsilon$ ($=d_4/d_2$) is greater than 0.5 but smaller than 1.2. Due to the geometrical relation of the cross section of the wire rope, however, when the diameter $d_4$ of the inscribed circle of the schenkels 3 is smaller than the schenkel diameter $d_2$, the torque coefficient can be reduced, so the diameter of the schenkel 3 and the number of schenkels 3 to be placed can be selected within the range of $0.5 \leqq \epsilon \leqq 1.2$.

If specific values, $\epsilon$=0.86 and $\eta$=1.14, are assigned to equation (7), $\theta$ becomes 37.8 degrees and the value obtained by rounding up of the number of schenkels N=180/$\theta$=4.7 to an integer is five, indicating the number of schenkels to be placed is five.

In this embodiment, five schenkels 3 are placed around an outer circumference; in comparison with a case in which six or more schenkels 3 are placed, a helical diameter in the twisting of the schenkels 3 (the diameter will be referred to as the schenkel layer core diameter $d_3$ below, and the relation $d_3$=2×R holds) can be made small. If the schenkel layer core diameter $d_3$ is reduced, the torque coefficient described above can be easily reduced.

The individual twisting pitches are set as follows: for a wire rope that has an outer rope diameter of 10 mm after the wire rope has been covered with a resin, the schenkel twisting pitch $L_1$ is set to 88 mm (outer diameter $d_1$ of the steel wire part of the wire rope=8.3 mm), the strand twisting pitch $L_2$ is set to 12.4 mm (schenkel diameter $d_2$=2.9 mm), and a fine steel wire twisting pitch $L_3$ is set to 7.1 mm (fine steel wire diameter $d_6$=0.89 mm). In the structure in which the strands 2 and the fine steel wires 2*a* to 2*g* are placed along circumferences in a single layer and six strands 2 are placed along a circumference, the strand twisting pitch $L_2$ is the minimum value determined from the manufacturing limit in twisting. The strand twisting pitch $L_2$ is 4.3 times as long as the schenkel diameter $d_2$, and the schenkel twisting pitch $L_1$ is 10.5 times as long as the outer diameter $d_1$ of the steel wire part of the wire rope to reduce the torque coefficient; the schenkel twisting pitch $L_1$ is longer even in comparison with the strand twisting pitch $L_2$. According to the above idea, when the outer diameter $d_1$ of the steel wire part of the wire rope is 8.3 mm, the schenkel twisting pitch $L_1$ becomes 88 mm. Although, in calculation, the schenkel twisting pitch $L_1$ is 10.5 times as long as the outer diameter $d_1$ of the steel wire part of the wire rope, the schenkel twisting pitch $L_1$ does not need to be fixed to 10.5 times and is preferably 10 to 11 times to efficiently reduce the torque coefficient.

As described above, according to this embodiment, if the diameter $d_4$ of the inscribed circle of a plurality of twisted schenkels 3 is smaller than the schenkel diameter $d_2$, the schenkels 3 can be brought close to the center of the wire rope; as a result, torque represented by the product of a force with which each schenkel 3 serves in the circumferential direction when a tensile force is exerted on the wire rope and the distance from the center of the wire rope to the center of the schenkel can be reduced. If the lay direction of the schenkels 3 and the lay directions of the fine steel wires and strands are made opposite to each other, the torque generated in the fine steel wires and stands and the torque generated in the schenkels are generated in directions in which these torques are mutually cancelled, so the entire torque of the rope is reduced; as a result, the rotating property in which the entire wire rope rotates around the central axis of the wire rope is reduced and the force with which the covering resin is twisted is thereby reduced; as a result, damage of the covering resin, which would be otherwise caused by the rotating property, can be suppressed.

REFERENCE SIGNS LIST

1: wire rope, 2: strand, 2*a* to 2*g*: fine steel wire, 3: schenkel, 4: inner layer resin, 4P: projection, 5: outer layer resin.

What is claimed is:

1. An elevator wire rope structured by twisting a plurality of sub-wire ropes, each sub-wire rope being formed by twisting a plurality of strands, each strand being formed by twisting a plurality of fine steel wires, an interior of the wire rope being filled with a resin, and a surface of the wire rope being covered with a resin, wherein a direction in which the fine steel wires and the strands are twisted and a direction in which the sub-wire ropes are twisted are mutually opposite, and a diameter of an inscribed circle of the plurality of twisted sub-wire ropes is smaller than a diameter of the sub-wire rope.

2. The elevator wire rope according to claim 1, wherein the sub-wire rope is formed by placing six strands along a circumference in a single layer, and the wire rope is formed by placing five sub-wire ropes on a circumference in a single layer.

3. The elevator wire rope according to claim 1, wherein when the diameter of the sub-wire rope is denoted $d_2$, the diameter of the inscribed circle is denoted $d_4$, and a resin thickness between adjacent sub-wire ropes is denoted $\delta$, if $\eta=\delta/d_2$ and $\epsilon=d_4/d_2$ are defined, $\epsilon$ is within a range of 0.5 to 1, an angle $\theta$ (degrees) is derived from $\theta=\sin^{-1}\{(1+\eta)/(1+\epsilon)\}$, and the number of sub-wire ropes N is an integer obtained by rounding up the value of 180/$\theta$.

4. The elevator wire rope according to claim 1, wherein a twisting pitch of the sub-wire rope is 10 to 11 times as long as an outer diameter of a steel wire part of the wire rope.

5. The elevator wire rope according to claim 1, wherein the resin filling the interior of the wire rope and the resin covering the surface of the wire rope are a urethane resin.

6. The elevator wire rope according to claim 1, wherein the resin filling the interior of the wire rope is an inner layer resin having a projection used to leave a spacing between the plurality of sub-wire ropes and the resin covering the surface of the wire rope is an outer layer resin that covers the plurality of sub-wire ropes, between which the spacing is left by the inner layer resin.

7. The elevator wire rope according to claim 2, wherein a twisting pitch of the sub-wire rope is 10 to 11 times as long as an outer diameter of a steel wire part of the wire rope.

8. The elevator wire rope according to claim 2, wherein the resin filling the interior of the wire rope and the resin covering the surface of the wire rope are a urethane resin.

9. The elevator wire rope according to claim 2, wherein the resin filling the interior of the wire rope is an inner layer resin having a projection used to leave a spacing between the plurality of sub-wire ropes and the resin covering the surface of the wire rope is an outer layer resin that covers the plurality of sub-wire ropes, between which the spacing is left by the inner layer resin.

10. The elevator wire rope according to claim 3, wherein a twisting pitch of the sub-wire rope is 10 to 11 times as long as an outer diameter of a steel wire part of the wire rope.

11. The elevator wire rope according to claim 3, wherein the resin filling the interior of the wire rope and the resin covering the surface of the wire rope are a urethane resin.

12. The elevator wire rope according to claim 3, wherein the resin filling the interior of the wire rope is an inner layer resin having a projection used to leave a spacing between the plurality of sub-wire ropes and the resin covering the surface of the wire rope is an outer layer resin that covers the plurality of sub-wire ropes, between which the spacing is left by the inner layer resin.

* * * * *